US006517279B1

(12) United States Patent
Camomilla et al.

(10) Patent No.: US 6,517,279 B1
(45) Date of Patent: Feb. 11, 2003

(54) TRAFFIC DIVIDER FOR CALIBRATING THE DECELERATION OF VEHICLES UPON IMPACT

(75) Inventors: Gabriele Camomilla; Stefano Bruschi, both of Rome (IT)

(73) Assignee: Autostrade Concessioni e Construzioni Autostrade S.p.A., Rome (IT)

( * ) Notice: Subject to any disclaimer, the term of this patent is extended or adjusted under 35 U.S.C. 154(b) by 0 days.

(21) Appl. No.: 09/744,717

(22) PCT Filed: May 25, 1999

(86) PCT No.: PCT/IT99/00146

§ 371 (c)(1),
(2), (4) Date: Jan. 30, 2001

(87) PCT Pub. No.: WO00/08258

PCT Pub. Date: Feb. 17, 2000

(30) Foreign Application Priority Data

Aug. 7, 1998 (IT) ..... RM98A0533

(51) Int. Cl.[7] ..... E01F 15/08

(52) U.S. Cl. ..... 404/6; 404/9; 404/10; 256/13.1

(58) Field of Search ..... 256/1, 13.1; 404/6, 404/9, 10, 11

(56) References Cited

U.S. PATENT DOCUMENTS 3,288,440 A * 11/1966 Schimmelpenninck et al. .. 256/13.1
3,982,734 A * 9/1976 Walker ..... 256/13.1
4,321,989 A * 3/1982 Meinzer ..... 256/13.1
4,423,854 A * 1/1984 Cobb et al. ..... 256/13.1
5,052,850 A * 10/1991 Bishop ..... 404/6
5,054,954 A 10/1991 Cobb et al.
5,531,540 A * 7/1996 Wasserstrom et al. ..... 404/6
6,168,346 B1 * 1/2001 Ernsberger ..... 404/6
6,276,667 B1 * 8/2001 Arthur ..... 256/13.1

FOREIGN PATENT DOCUMENTS

| | | |
|---|---|---|
| DE | 23 37 498 | 2/1975 |
| GB | 1073416 | 6/1967 |
| WO | WO 98/19015 | 5/1998 |

* cited by examiner

*Primary Examiner*—Robert E. Pezzuto
*Assistant Examiner*—Alexandra K Pechhold
(74) *Attorney, Agent, or Firm*—Young & Thompson

(57) ABSTRACT

A safety barrier for roads, used as a traffic divider, includes a double row of concrete made New Jersey barrier elements which allow the realization of a hedge on earth interposed between the barrier elements. The earth is contained in a sack made of nonwoven fabric, fixed, to both barrier elements, so as to leave gaps behind the rear walls of the barrier elements. The gaps together with a plurality of sliders or runners provided on the barrier's base, allow during impact a controlled displacement of the barrier elements. The calibration of decelerations is adjusted by the material used for the sliders.

20 Claims, 4 Drawing Sheets

TRAFFIC DIVIDER FOR CALIBRATING THE DECELERATION OF VEHICLES UPON IMPACT

TECHNICAL FIELD

The present invention relates to a traffic divider, and in particular to a bifilar (i.e. forming two rows) asymmetric barrier, with an amount of earth interposed for the purpose of providing an ornamental hedge acting as protection means against light rays.

More specifically, the barrier according to the invention is a barrier of this kind, having a New Jersey profile comprising several prefabricated modules.

BACKGROUND ART

As known, road safety barriers, and in particular those to be installed as traffic dividers on motorways, are required to withstand high energies of about 600 kJ, in order to prevent being dislodged by vehicles having a weight of more than 40 tons and a high centre of gravity.

Barriers with a high resistance are therefore very rigid; for this reason, upon impact by a light vehicle (automobiles having a weight between 800 and 1500 Kg), even at very high speeds corresponding to energies up to 70 kJ, no problem is encountered with respect to vehicle retention, but the decelerations transmitted to the passengers may be very high and fatal.

In many cases of accidents caused by automobiles, the relatively low energies involved, are not sufficient to trigger a displacement of the barrier so as to calibrate and reduce the decelerations.

Barriers preventing dislodging by vehicles with a weight between 3 and 44 tons, may represent a fatal obstacle (because of their rigidity) upon impact by automobiles having a weight comprised between 800 and 1500 Kg.

On the other hand, it is obvious, however, that in the field of safety barriers for roads the most important problem is to obtain protection and prevent displacement of the barrier—particularly in the case of traffic dividers—, for the whole variety of vehicles circulating on the road, which have extremely different masses, dimensions and velocities.

At present, the bivalence or twofold nature of the barrier (the guarantee of protection both for heavy vehicles and light vehicles), is obtained using barriers made of concrete and with a shape of their inner side—facing the road—, which is named "New Jersey", and which is useful for "lifting" the light vehicle and realign it with respect to the carriageway, in case of very low impact energies.

The impact energy is low if the impact angle and/or the velocity is low.

Summing up, the present "New Jersey" barriers used as traffic dividers, having an amount of interposed earth, are unable to calibrate the decelerations which the barrier transmits to a light vehicle hitting the barrier with a high impact angle and a high velocity; the impact energy of the light vehicle, being high but not extremely high, may fail to cause a displacement of the barrier, which has a considerable mass (about 3 tons per meter).

Actually, the vehicle path is redirected but the the passengers may be severely injured or die, due to the high accelerations transmitted during the impact.

DISCLOSURE OF INVENTION

An object of the present invention is to realize a traffic divider of the New Jersey type made of prefabricated concrete modules, being suited to calibrate the decelerations of the vehicle upon impact, according to the type of vehicle and its impact energy, the latter being determined by its mass, velocity and impact angle with respect to the barrier.

The barrier of the present invention must however always ensure the retention of a colliding vehicle having a noticeable mass (from 3 to 44 tons), so as to maintain its "bivalence".

Moreover, the barrier must ensure, by means of the earth interposed between the two rows of the New Jersey barrier, the realization and maintenance of an ornamental hedge serving as a means of protection against light rays.

The above object is obtained with a two-row (bifilar) asymmetric barrier, comprising a mass of interposed earth, by providing a receptacle for said earth, which is laid on the embankment and forms two continuous gaps (spaces) behind the rear wall of each element of the barrier.

Preferably, said receptacle is formed by a "sack" of nonwoven fabric, suited to allow the passage of rain water and to ensure the growth and maintenance of the hedge.

The receptacle is preferably laid on the embankment, between both elements of the traffic divider, and is hooked to brackets or supports fixed at the upper ends of the barrier elements.

In this manner, the calibration of the resistant forces (and of the resultant decelerations) in case of impacts caused by automobiles with energies up to 65–70 kJ, is obtained through a first "free" displacement, of some centimeters, and through a second step which starts when the barrier which is hit by the vehicle abuts the mass of earth (loam soil which is lightened by the addition of expanded clay or the like) contained inside the sack, and causes a partial lateral compression of said earth, since the latter is neither much compacted, nor hindered by an obstacle on its rear side.

Therefore, since the mass of earth (before impact and in the initial condition) does not abut the barrier elements, the barrier is able to move rearwards , thereby limiting the vehicle deceleration.

On the other hand, in case of an impact caused by a heavy vehicle, where the energies involved are much higher, the displacement of the barrier does not end after the step previously described, instead, it continues and causes the displacement of the sack, until abutment with the other barrier element and compression of said amount of earth occurs.

The barrier is therefore suited to provide resistant forces which increase as a function of the energies involved during the impact, and at the same time it is suited to calibrate the decelerations of the vehicle and consequently of its passengers.

In order to facilitate the displacement of the barrier, during the first step of the impact, or in case of an impact due to a light vehicle, according to a further aspect of the invention the barrier may be provided on its lower side with devices or runners which are fixed to the module of the barrier and/or to the support of the foundation (for instance the curbstone made of concrete, the road pavement or the soil).

Varying the relevant parameters such as the weight of the barrier, the extension of the runner's surface, the features of the abutting surfaces (friction coefficient), it is possible to improve calibration of the decelerations in the first step of the impact.

Preferably, the runners are formed by stainless steel plates with a flat smoothed surface.

It is possible to fix a first stainless steel plate to a barrier module, and a second steel plate of identical extension, to the foundation curbstone, if any, or to the pavement.

Between said plates it is possible to insert a sheet or layer of material with a low friction coefficient, like "Teflon," for instance.

BRIEF DESCRIPTION OF DRAWINGS

The present invention will now be explained in more detail only for illustrative and non-limitative purposes, by means of a particular embodiment thereof which is shown in the drawings, in which.

BEST MODE OF CARRYING OUT THE INVENTION

Figure 1:
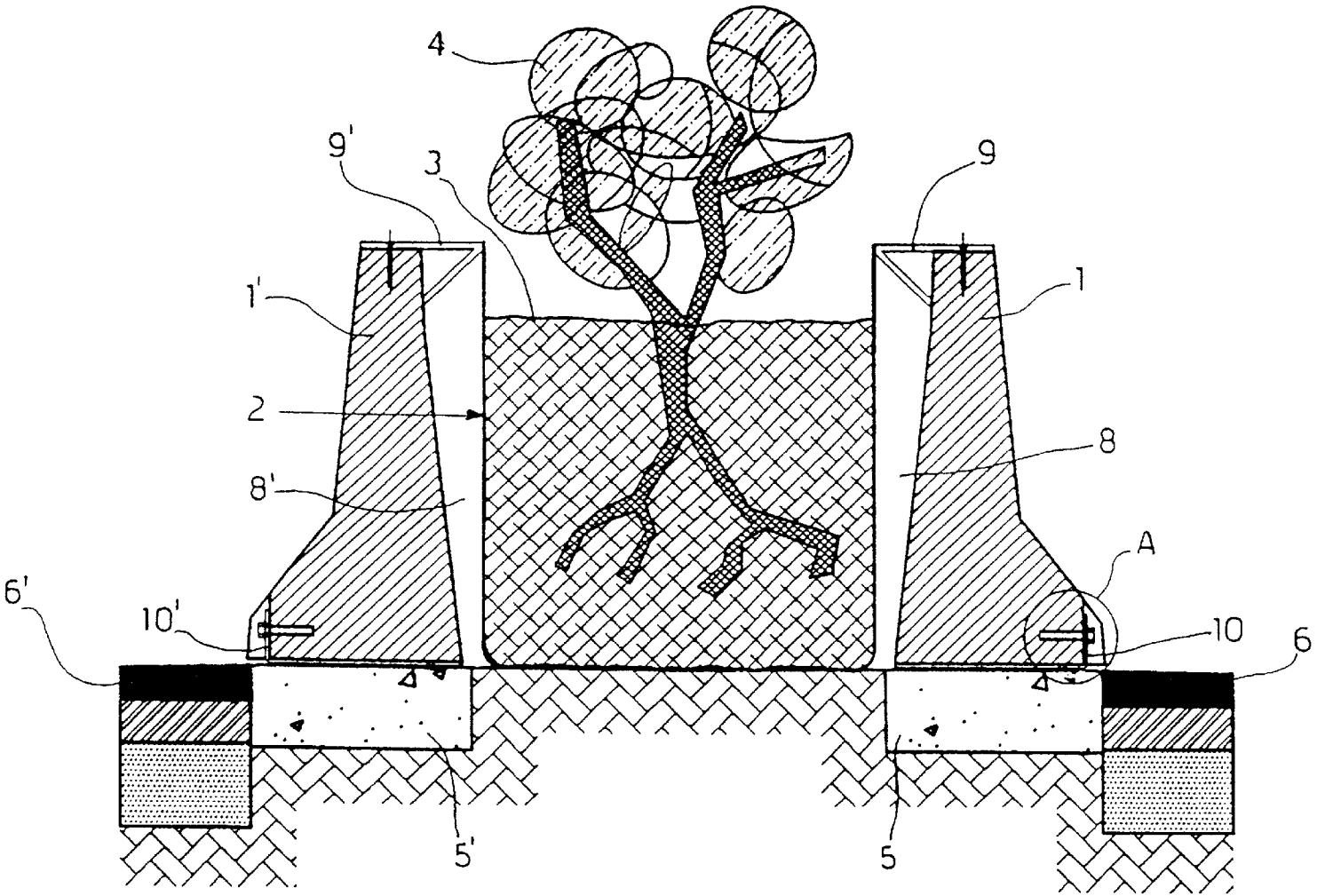
FIG. 1 is a cross-sectional view of a two-row (bifilar) asymmetric barrier with an amount of interposed earth, according to the invention, in the initial condition (before the impact)
Figure 2:
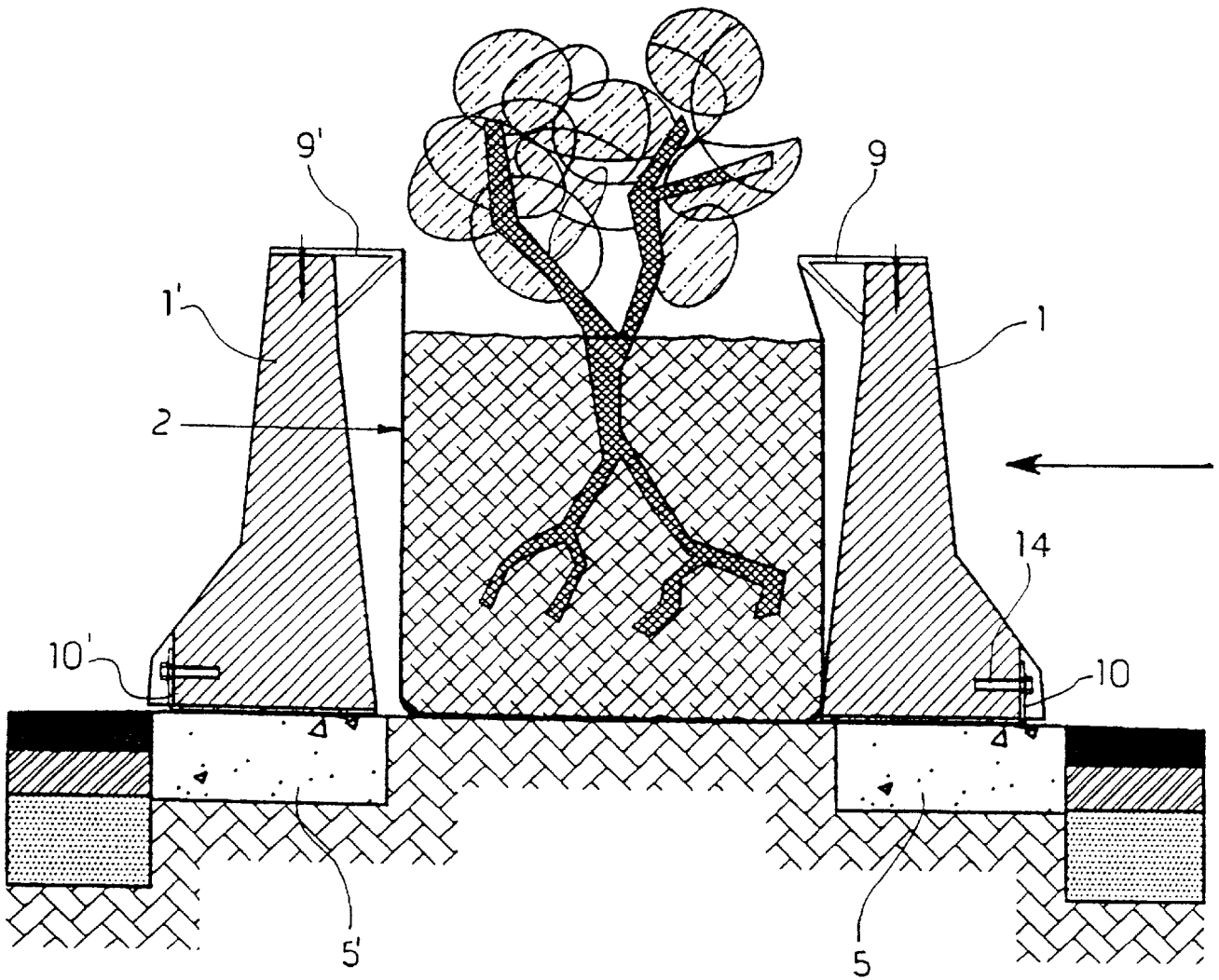
FIG. 2 shows the free displacement of the barrier of FIG. 1, in the initial step of the impact.
Figure 3:
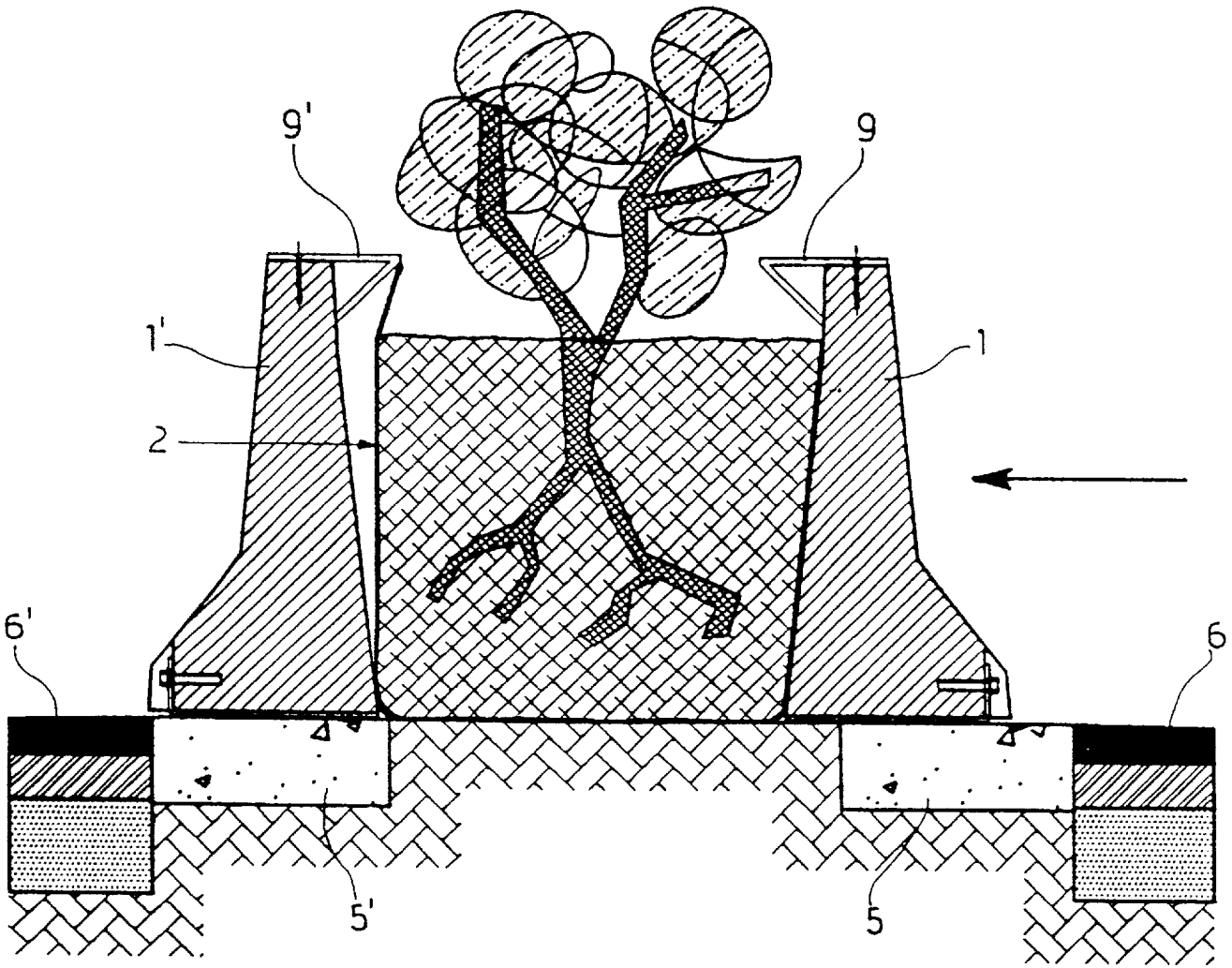
FIG. 3 shows the displacement of the barrier of FIG. 1 and the compression of the earth during the second step of the impact, which would be caused only in a small amount by a light vehicle, but entirely by a heavy one.

The figures show a two-row asymmetric traffic divider including an amount of interposed earth, and of the so-called New Jersey type, according to the present invention, comprising two asymmetric, continuous, concrete-made modular elements 1, 1', between which is arranged a receptacle 2 for the earth 3 (loam soil lightened by adding expanded clay or the like). The upper layer of said earth amount 3 is preferably formed exclusively by expanded clay and forms the mulching (soil cover) for the protection of the ornamental plants used as a hedge 4 for protection against the light rays.

In the present description and in the claims, the word "earth" means any kind of mixture obtained by combining loam soil and expanded clay or some other kind of light material of analogous features, employing variable ratios between the volumes of the single components in order to vary the specific weight and consequently the weight per meter, according to the desired displacements and decelerations to be produced by the vehicles hitting the barrier 1,1'.

It can be seen that the receptacle 2 does not extend inside the whole space between the two continuous elements 1, 1' forming the barrier, instead, it leaves two gaps or spaces of variable size according to the maximum allowable free displacement (in the first step of the impact) of the barrier element 1 or 1', which is simply laid on the foundation support.

In the figures, the continuous elements 1 or 1' are laid on concrete-made curbstones, denoted by 5, 5', but this is not always the case. It is also possible that, due to a work performed previously on the road (for instance, widening of the road), the two elements 1, 1' will be laid on the road pavement, like that indicated by 6, 6', and that, possibly, the road pavement 6, 6' continuosly extends below the whole barrier 1, 1'.

Figure 5:
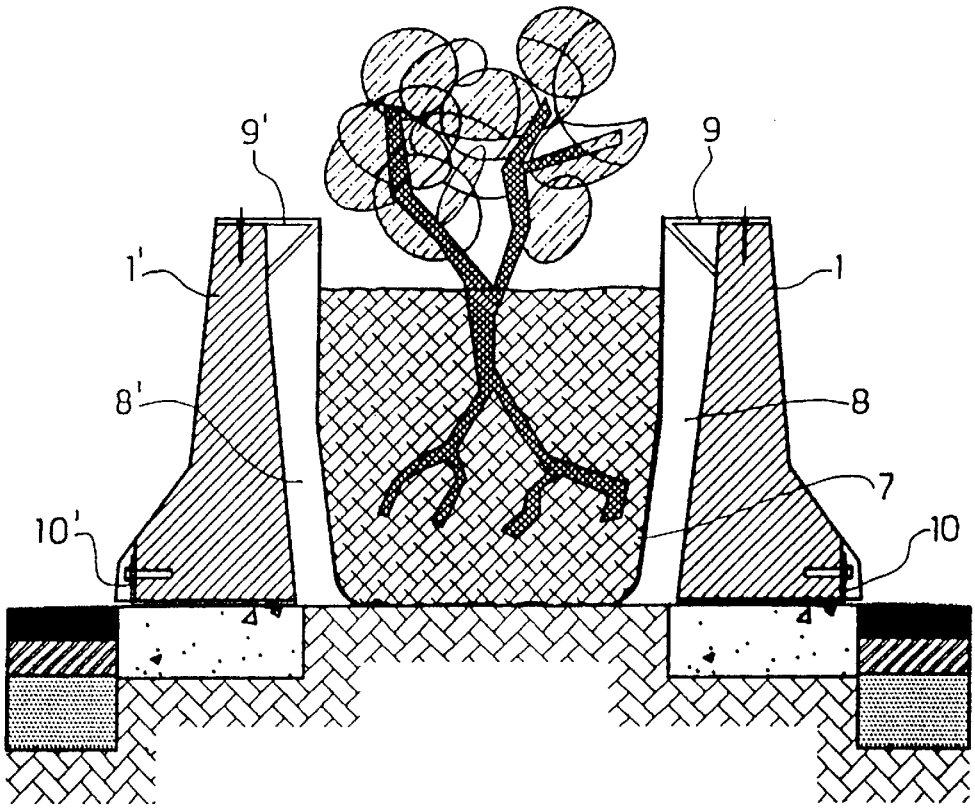
FIG. 5 is a sectional view of an alternative embodiment for the shape of the sack made of nonwoven fabric shown in FIG. 1, suited to increase the gaps with respect to the New Jersey barriers; the initial condition (before the impact) being shown In this figure.

Preferably, the receptacle 2 is made by a sack of non woven fabric, which may be reinforced and protected by a net with variable mesh of suitable material (e.g. nylon, plastics, etc) or geo-textile (that is environment friendly fabric) material, which allows the passage of water and at the same time gives a certain toughness and the desired shape to the "sack" 2. This external covering of the receptacle 2 makes possible to realize different configurations of the "sack" 2, for instance like the one shown in the variant of FIG. 5. In this figure, the lower portion 7 of the receptacle 2 is parallel to both barrier elements 1, 1', so that, in contrast with the representation of FIG. 1, the two gaps 8, 8' do not become narrower towards the base of the barrier.

Obviously, the shape of the gaps 8, 8' may vary according to the design.

At its upper end the receptacle 2 is fixed by means of hooks or the like, to holding brackets 9, 9', which may extend continuously or discontinuously along the barrier. The holding brackets 9, 9' must not resist to a high weight, since the receptacle 2 is laid for this reason on the embankment, and the hooking system must be provided with screw couplers or the like, which can adjust the tension and the "traction" exerted by the receptacle 2.

A fixing system of a removable kind, comprising hooks or the like, allows to replace the receptacle 2.

If in case of impact of the barrier by heavy vehicles the barrier resistance is to be increased, the sack 2 may also be arranged so that its base penetrates inside a cavity or trench (not shown) which is parallel to the barrier and is formed in the embankment, between the two elements 1,1'.

It is also possible to realize the receptacle 2 in a continuous form, in the longitudinal direction, by means of superposition, or to realize perimetrically closed sacks to be located at desired reciprocal distance. In this case it is not necessary to hook the sack to the barriers 1, 1', by means of hooks connected to the brackets 9, 9'. Therefore, it is further possible to calibrate the resistance provided by the barrier and the decelerations as a function of the longitudinal distribution of the earth containing sacks.

Figure 4:
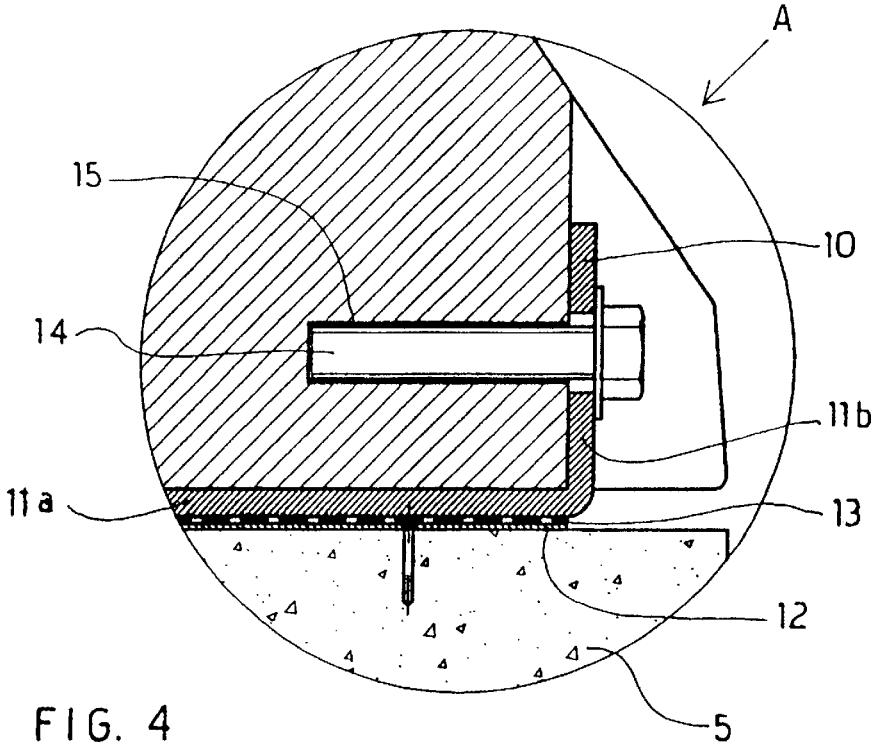
FIG. 4 is a detail of FIG. 1, showing (in cross section) a particular embodiment of the runners, mounted in the junction region of the New Jersey barrier.

As shown in FIG. 1 (detail indicated by A) and in the corresponding enlarged view shown in FIG. 4, at the base of the modules making up each barreir element 1, 1', there are provided runners (sliders) allowing the calibration of the decelerations of a colliding vehicle.

Said runners or sliders comprise:

- an upper plate 10 (for instance of stainless steel) which is fixed to the barrier, including a lower portion 11*a* and a vertical portion 11*b* which are integrally formed (actually the plate forms an angle iron);
- a lower plate 12 (e.g. stainless steel) having in general a smaller thickness than the thickness of the upper plate 10, and which is fixed to the support 5;
- a layer of material with a low friction coefficient, for instance a Teflon sheet 13, arranged in sandwich-like fashion between said plates 10, 12, and fixed or glued to either of the plates 10, 12.

According to the present embodiment, the upper plates 10, 10' (FIG. 1) of the barrier 1, 1' are also used in order to connect two respective adjacent modules. For that purpose (as shown in FIG. 4 corresponding to detail A of FIG. 1; note also that the slider of the element 1' is completely symmetrical), bolts 14 are introduced at the foot of the element 1, inside respective threaded bushes 15.

A bush 15 is embedded in the concrete, at the foot of a module, whereas the other bush is embedded in the concrete of the foot of the adjacent module. Obviously, the cross section can only show a single bolt 14 and a single corresponding bush 15.

It can be appreciated that a different calibration of the resistance provided by the barrier can be obtained by choosing different areas of the sliders in contact with each another—in the present case the Teflon film 13 and the lower steel plate 12—, and also by varying the materials and the weight of the continuous elements 1,1'.

By varying the paramenters in a suitable way, tha value of the decelerations can be optimized in the first step or first period of the impact, so as to ensure maximum protection also to the vehicles with a weight between 800 and 1500 kg.

The present invention is not limited to the case of sliders arranged at the junction between adjacent modules. The sliders or runners can be mounted at different locations on the base of the elements 1,1'; in this case the vertical portion 11*b* used for the connection, could be omitted, and the upper runner 10 can be formed only by the horizontal portion 11*a*, fixed for instance by screw anchors to the base of the elements 1, 1'.

Moreover, the portion 11*a* and the lower plate 12 may extend from one end to the other of the base of the module, in the transversal or longitudinal direction. The number of runners or sliders, provided for each module, may also vary.

The detail A of FIG. 4 should not be interpreted in a limitative way. A skilled reader can appreciate that a sliding device may comprise only the upper plate, or only the lower plate, or only the two plates, omitting the layer or sheet of very low friction material arranged between the plates themselves.

Moreover, it is also possible to conceive a combination of differently configured sliding devices.

The sliders may be fixed using instead of pins (see plate 12) or bolts 14 (see plate 10) any other known method, e.g. a magnetic means, or glues, resins, etc.

What is claimed is:

1. A safety barrier for roads, forming a traffic divider, comprising:

two rows of modular elements made of concrete; and an amount of earth which is interposed between said concrete made elements, wherein said amount of earth is contained inside a receptacle laid on an embankment, and said receptacle extends along a whole length of one of said concrete made elements and leaves two gaps between the receptacle and a rear wall of the concrete made elements, said concrete made elements have on a lower surface a plurality of sliders allowing a calibration of a deceleration of a vehicle during a first period of an impact, that is until one of the concrete made elements abuts the receptacle.

2. A safety barrier for roads according to claim 1, wherein a lower portion of said receptacle is inserted in a cavity extending longitudinally with respect to the concrete made barriers.

3. A safety barrier for roads according to claim 1, wherein the receptacle is removably fixed to supporting brackets which are rigidly connected to an upper end of the concrete made elements.

4. A safety barrier for roads according to claim 3, wherein the brackets are continuous or interrupted.

5. The safety barrier for a road according to claim 3, further comprising hooks from removably fixing said receptacle to the supporting brackets.

6. A safety barrier for roads according to claim 1, wherein the sliders (A) suited for the calibration of the decelerations of the colliding vehicle, by adapting parameters such as their surface extension, their friction coefficient, and the weight of the barrier (1, 1'), include a flat upper plate (10) fixed to the barrier element (1, 1').

7. A safety barrier for roads according to claim 6, wherein the sliders suited for the calibration of the decelerations of the colliding vehicle, by adapting parameters such as their surface extension, their friction coefficient and the weight of the barrier, include a lower flat plate which is fixed to a support of a foundation of the roads.

8. A safety barrier for roads according to claim 7, wherein the sliders include both the lower plate and the upper plate, and a layer between the upper and lower plates formed by a material with a very low friction coefficient.

9. A safety barrier for roads according to claim 6, wherein said upper plate is located at a junction between two adjacent concrete made elements and connects said two adjacent concrete made elements to each other.

10. A safety barrier for roads according to claim 9, wherein for obtaining the the connection of two modules, the upper plate (10) includes a vertical portion (11*b*) besides a horizontal portion (11*a*), and said vertical portion comprises holes for bolts (14) which are introduced in threaded bushes (15) embedded in the concrete of two adjacent modules, at the foot of the barrier elements (1; 1').

11. A safety barrier for roads according to claim 1, wherein the sliders extend in a transversal direction with respect to a base of one of the concrete made elements, from one end to an opposite end thereof, or are arranged in a discontinuous way.

12. A safety barrier for roads according to claim 1, wherein the earth is composed of a mixture of loam soil and expanded clay, in order to vary the weight and the firmness or toughness of the earth as a function of the desired resistance to compression, that is as a function of the resistance the barrier is expected to provide against a heavy vehicle.

13. A safety barrier for roads according to claim 1, wherein the receptacle is non-continuous in a longitudinal direction and comprises separate perimetrically closed sacks arranged at variable reciprocal distances in the longitudinal direction.

14. A safety barrier for roads according to claim 1, wherein the sliders suited for the calibration of the deceleration of the colliding vehicle, by adapting parameters such as their surface extension, their friction coefficient and one weight of the barrier, include a lower flat plate which is fixed to a support of a foundation of the roads.

15. A safety barrier for a road, forming a traffic divider comprising:

two rows of modular concrete elements; and a receptacle containing earth being interposed between said modular concrete elements and contacting an embankment of the road, said receptacle extending along an entirety of the first and second modular concrete elements, and leaving first and second gaps between said receptacle and a rear wall of the first and second barrier elements, said first and second barriers including a lower surface having a plurality of sliders, said plural sliders being structured and arranged to decelerate a vehicle during a first period of an impact, prior to when one of said first and second modular concrete elements abuts said receptacle, wherein said receptacle is a sack of non-woven fabric having an external cover and is reinforced by a material that allows water to pass.

16. A safety barrier for roads according to claim 15, wherein the receptacle is non-continuous in a longitudinal direction and comprises separate perimetrically closed sacks arranged at variable reciprocal distances in the longitudinal direction.

17. A safety barrier for roads according to claim 16, wherein the external cover and the reinforcement material are structured and arranged to give a specific configuration to a lower portion of the receptacle to vary a transversal extension and a form of the two gaps.

18. The safety barrier for a road according to claim 15, wherein the material is a net of one of a nylon, an environment friendly textile and a "geotextile" material.

19. A safety barrier for a roadway, comprising:

first and second modular self-supported concrete barriers;

a receptacle containing earth being between said barriers and contacting an embankment of the roadway, said receptacle extending longitudinally along a length of the barriers;

first and second gaps being between the receptacle and the first and second barriers, respectively, said first and second gaps extending longitudinally along the length of the first and second barriers and along an entirety of a height of the receptacle, said first and second barriers being movable, independent from the receptacle, from a first position apart from the receptacle to a second position contacting the receptacle.

20. The safety barrier for a road according to claim 19, further comprising a plurality of sliders connected to a lower portion of each of said first and second barriers.

* * * * *